US009568866B2

(12) United States Patent
Yamaguchi et al.

(10) Patent No.: US 9,568,866 B2
(45) Date of Patent: Feb. 14, 2017

(54) IMAGE FORMING APPARATUS AND IMAGE FORMING METHOD WITH VARIABLE RECORDING MEDIUM CONVEYANCE SPEED

(71) Applicant: Konica Minolta, Inc., Chiyoda-ku, Tokyo (JP)

(72) Inventors: Toru Yamaguchi, Koganei (JP); Makoto Fujii, Hino (JP); Mikihiko Takada, Hino (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 0 days.

(21) Appl. No.: 14/925,075

(22) Filed: Oct. 28, 2015

(65) Prior Publication Data

US 2016/0124358 A1 May 5, 2016

(30) Foreign Application Priority Data

Nov. 4, 2014 (JP) ..... 2014-224642

(51) Int. Cl.
*G03G 15/20* (2006.01)

(52) U.S. Cl.
CPC .. *G03G 15/2032* (2013.01); *G03G 2215/2045* (2013.01)

(58) Field of Classification Search
CPC ..... G03G 15/2028
USPC ..... 399/68, 322
See application file for complete search history.

(56) References Cited

U.S. PATENT DOCUMENTS 5,956,554 A * 9/1999 Yanashima

FOREIGN PATENT DOCUMENTS

JP 2008233770 A 10/2008

* cited by examiner

*Primary Examiner* — Walter L Lindsay, Jr.
*Assistant Examiner* — Milton Gonzalez
(74) *Attorney, Agent, or Firm* — Cantor Colburn LLP

(57) ABSTRACT

To provide an image forming apparatus and an image forming method which can rapidly decrease (cool) the temperature of a fixing section. The image forming apparatus of the invention includes a fixing section fixing a toner image on a sheet, and a controller performing switching control of press-contact state/separated state of the fixing section, and conveyance control of the sheet. The controller, after completion of printing, rapidly cools the fixing section while keeping it in the press-contact state by conveying the sheet at a first conveying speed. The controller naturally cools the fixing section by bringing it into the separated state at a predetermined timing to convey the sheet at a second conveying speed slower than the first conveying speed, and stops conveying it when the temperature of the fixing section becomes not higher than a predetermined temperature.

6 Claims, 10 Drawing Sheets

| FIXING TEMPERATURE [°C] | CONVEYING SPEED OF SHEET | | | | | | |
|---|---|---|---|---|---|---|---|
| | ON[SEC] | 0.1 | | | | | |
| | OFF[SEC] | 0.3 | 0.7 | 1.6 | 3.7 | 8.4 | 19.3 |
| | AVERAGE SPEED[mm/s] | 31.6 | 15.8 | 7.4 | 3.3 | 1.5 | 0.8 |
| 200 | | | | | | | |
| 180 | | ○ | ○ | × BUBBLE | | | |
| 160 | | ○ | ○ | × BUBBLE | × BUBBLE | | |
| 140 | | | | ○ | × BUBBLE | | |
| 120 | | | | | ○ | ○ | △ |

IMAGE FORMING APPARATUS AND IMAGE FORMING METHOD WITH VARIABLE RECORDING MEDIUM CONVEYANCE SPEED

CROSS REFERENCE TO RELATED APPLICATIONS

The present invention claims priority under 35 U.S.C. §119 to Japanese Application No. 2014-224642, filed Nov. 4, 2014, the entire content of which is incorporated herein by reference.

BACKGROUND OF THE INVENTION

Field of the Invention

The present invention relates to an image forming apparatus and an image forming method.

Description of the Related Art

Electrophotographic image forming apparatuses are widely used, in which a toner image formed on a photoreceptor is transferred to a recording medium such as a sheet, and the recording medium having the toner image transferred thereon is heated and pressurized in a high-temperature fixing section, whereby the toner image is fixed on the recording medium. Electrophotographic image forming apparatuses are applied, for example, to copy machines, printer devices, facsimile machines, printing machines, and multifunction devices.

In the case where the recording medium is a sheet rolled into a roll form (hereinafter, referred to as a "roll sheet"), or a continuous-form paper sheet, the sheet is set in the fixing section even during standby (not printing) when printing is not performed. During printing operations, the sheet is conveyed in a state where the temperature of the fixing section is increased to fix the toner image onto the sheet. On the other hand, during standby, the sheet is stopped, and hence, may deform or discolor due to the temperature of the fixing section. The sheet deformed or discolored is treated as a so-called waste sheet (spoiled sheet).

Patent Literature 1 discloses a technique that prevents the sheet from deforming or discoloring due to the temperature of the fixing section. With the conventional technique described in Patent Literature 1, a conveying roller pair is driven or stopped in a sheet conveying direction at a specified interval during standby in which the sheet is stopped, to remove the slack of the sheet, thereby preventing the sheet from deforming or discoloring due to contact of the sheet with a hot roll.

RELATED ART DOCUMENT

Patent Document

Patent Literature 1: Japanese Patent Laid-Open Publication No. 2008-233770

DISCLOSURE OF THE INVENTION

Problems to be Solved by the Invention

As described above, in the case where a roll sheet or continuous-form paper sheet used as the recording medium, the sheet is set in the fixing section. Thus, it is necessary to decrease the temperature of the fixing section to a safe temperature at which the sheet does not deform or is not damaged. However, in the conventional technique described in Patent Literature 1, decreasing (cooling) the temperature of the fixing section is not taken into consideration.

In view of the circumstances described above, an object of the present invention is to provide an image forming apparatus and an image forming method, which can appropriately decrease (cool) the temperature of the fixing section.

SUMMARY OF THE INVENTION

Means for Solving the Problem

In order to achieve the object described above, an image forming apparatus according to one aspect of the present invention includes: a fixing section configured to fix a toner image on a recording medium; and a controller configured to perform control of switching the fixing section between a press-contact state and a separated state, and conveyance control of controlling a conveying speed of the recording medium. The controller conveys the recording medium at a first conveying speed after completion of printing while keeping the fixing section in the press-contact state, and then brings the fixing section into the separated state at a predetermined timing to convey the recording medium at a second conveying speed slower than the first conveying speed. Then, the controller stops conveying the recording medium at a time when a temperature of the fixing section becomes not higher than a predetermined temperature.

Furthermore, an image forming method according to one aspect of the present invention, in an image forming apparatus including a fixing section that fixes a toner image on a recording medium, conveys the recording medium at a first conveying speed after completion of printing while keeping the fixing section in a press-contact state, and then brings the fixing section into a separated state at a predetermined timing to convey the recording medium at a second conveying speed slower than the first conveying speed. Then, the method stops conveying the recording medium at a time when a temperature of the fixing section becomes not higher than a predetermined temperature.

With the image forming apparatus or the image forming method having the configuration described above, the recording medium is conveyed at the first conveying speed from after completion of printing until a predetermined timing while the fixing section is being kept in the press-contact state, which makes heat of the fixing section transferred to the recording medium through thermal conduction, whereby the heat is dissipated through the recording medium. In other words, the recording medium functions as a heat dissipating body. With this configuration, the fixing section is rapidly cooled (forcibly cooled), which accelerates decrease in temperature of the fixing section. Then, the fixing section is brought into the separated state at a predetermined timing, and the recording medium is conveyed at the second conveying speed, which is slower than the first conveying speed, whereby the fixing section is naturally cooled.

Effects of the Invention

According to the present invention, rapid cooling, in which heat is dissipated through the recording medium, and natural cooling are combined, so that the temperature of the fixing section can be appropriately decreased (cooled).

BRIEF DESCRIPTION OF THE DRAWINGS

FIGS. 4A and 4B are explanatory views of a cooling operation of the fixing section, in which FIG. 4A illustrates a case of rapid cooling and FIG. 4B illustrates a case of natural cooling.

DESCRIPTION OF THE PREFERRED EMBODIMENTS

Hereinbelow, a form (hereinafter, referred to as an "embodiment") of carrying out the present invention will be described in detail with reference to the drawings. The present invention is not limited to this embodiment. In this specification and the drawings, the same reference signs are attached to the same constituent elements or constituent elements having substantially the same function, and explanation thereof will not be repeated.

<Image Forming System to which the Present Invention is Applied>

Figure 1:
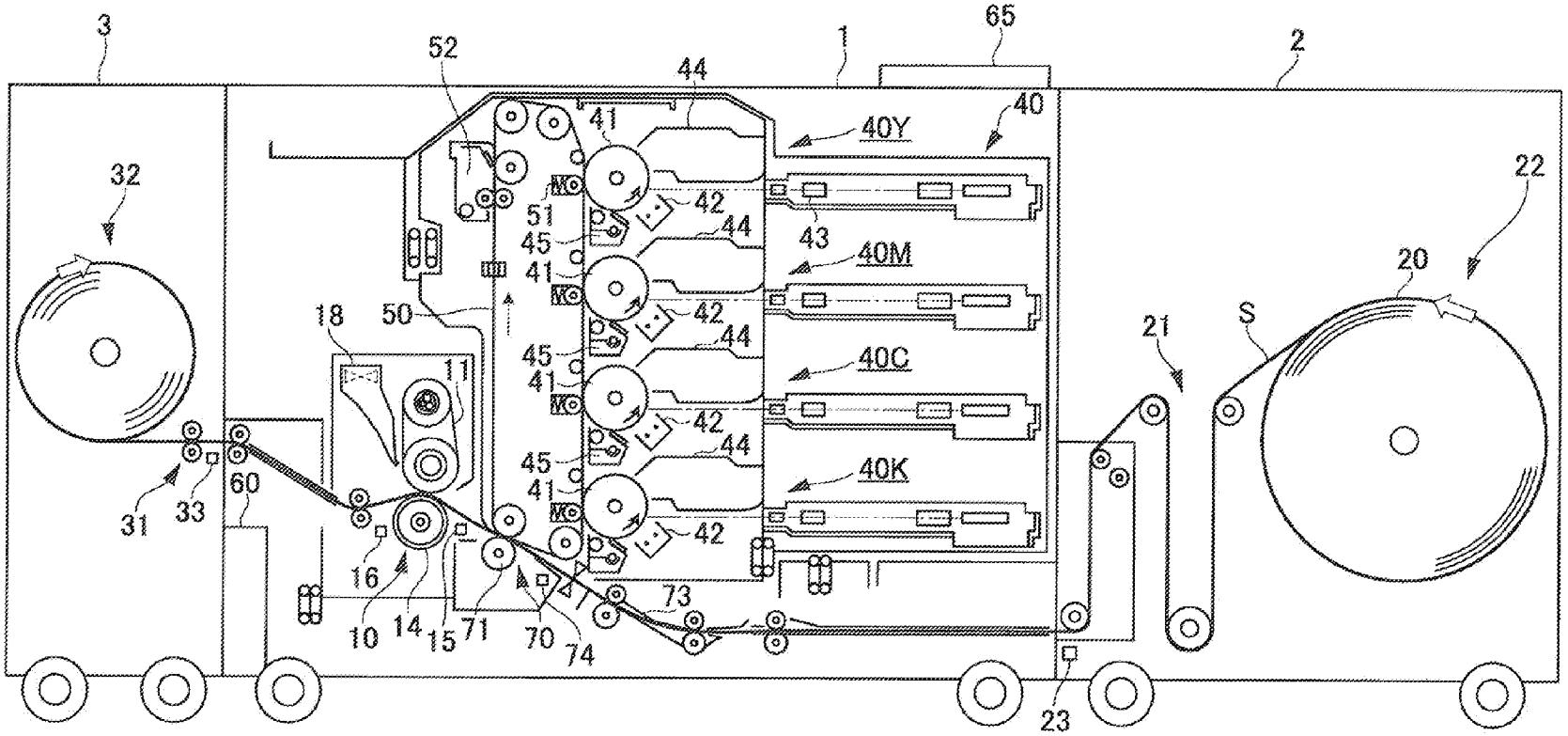
FIG. 1 is a schematic configuration diagram illustrating a configuration example of an image forming system to which the present invention is applied.

FIG. 1 is a schematic configuration diagram illustrating a configuration example of an image forming system to which the present invention is applied. As illustrated in FIG. 1, an image forming system 100 according to this application example includes an image forming apparatus 1, a sheet feeding device 2 that supplies a roll sheet S to the image forming apparatus 1, and a sheet receiving device 3 that winds up the roll sheet S ejected from the image forming apparatus 1. The image forming apparatus 1 is the image forming apparatus according to the embodiment of the present invention. The roll sheet S is a recording medium (long sheet) wound into a roll form. Each configuration of the image forming apparatus 1, the sheet feeding device 2, and the sheet receiving device 3 will be described below.

[Image Forming Apparatus]

First, the image forming apparatus 1 will be described. The image forming apparatus 1 employs an electrophotography to form an image on the roll sheet S using static electricity, and is a color image forming apparatus with a tandem method in which toners of four colors, yellow (Y), magenta (M), cyan (C), and black (Bk), are overlapped.

As illustrated in FIG. 1, the image forming apparatus 1 includes a conveying unit 73, an image forming section 40, an intermediate transfer belt 50, a secondary transfer section 70, a fixing section 10, a blowing device 18, an upstream-side sensor 15, a downstream-side sensor 16, an operation controlling section 65, and a controller 60.

The conveying unit 73 includes plural conveying rollers provided on the upstream side of the secondary transfer section 70, and continuously conveys the roll sheet S conveyed from the sheet feeding device 2, to the secondary transfer section 70 provided at a transfer position.

The image forming section 40 has four image forming units 40Y, 40M, 40C, and 40K for forming a toner image of yellow (Y), a toner image of magenta (M), a toner image of cyan (C), and a toner image of black (Bk).

The first image forming unit 40Y forms a toner image of yellow. The second image forming unit 40M forms a toner image of magenta. The third image forming unit 40C forms a toner image of cyan. The fourth image forming unit 40K forms a toner image of black. These four image forming units 40Y, 40M, 40C, and 40K have the same configuration. Thus, here, only the first image forming unit 40Y will be described.

The first image forming unit 40Y includes a drum-shaped photoreceptor 41, and a charging section 42, an exposure section 43, a developing section 44, and a cleaning device 45 which are disposed around the photoreceptor 41. The photoreceptor 41 is rotated in a counterclockwise direction with drive by a driving motor (not illustrated). The charging section 42 gives an electric charge to the photoreceptor 41 to uniformly charge the surface of the photoreceptor 41. The exposure section 43 performs exposure and scanning on the surface of the photoreceptor 41 on the basis of image data transmitted from the outside to form an electrostatic latent image on the photoreceptor 41.

The developing section 44 causes yellow toner to adhere to the electrostatic latent image formed on the photoreceptor 41. With the operation, a toner image of yellow is formed on the surface of the photoreceptor 41. Note that the developing section 44 of the second image forming unit 40M causes magenta toner to adhere to the photoreceptor 41, and the developing section 44 of the third image forming unit 40C causes cyan toner to adhere to the photoreceptor 41. Furthermore, the developing section 44 of the fourth image forming unit 40K causes black toner to adhere to the photoreceptor 41.

The toner adhering onto the photoreceptor 41 is transferred to the intermediate transfer belt 50. The cleaning device 45 removes the toner remaining on the surface of the photoreceptor 41 after the toner is transferred to the intermediate transfer belt 50.

The intermediate transfer belt 50 is formed into an endless shape, and is stretched around plural rollers. The intermediate transfer belt 50 is rotated with drive by a driving motor (not illustrated) in a clockwise direction, which is the opposite direction of the rotation direction of the photoreceptor 41. A primary transfer section 51 is provided in the intermediate transfer belt 50 at a position facing the photoreceptor 41 of each of the image forming units 40Y, 40M, 40C, and 40K. The primary transfer section 51 applies a voltage having a polarity opposite to that of toner, to the intermediate transfer belt 50 to transfer the toner image formed on the photoreceptor 41 to the intermediate transfer belt 50.

Furthermore, as the intermediate transfer belt 50 rotates, the toner images formed with the four image forming units 40Y, 40M, 40C, and 40K are sequentially transferred to the surface of the intermediate transfer belt 50. Thereby, a toner image of yellow, a toner image of magenta, a toner image of cyan, and a toner image of black are overlapped on the intermediate transfer belt 50, whereby a color image is formed.

The secondary transfer section 70 is disposed on the downstream side of the conveying unit 73 in the sheet conveying direction and in the vicinity of the intermediate transfer belt 50. The secondary transfer section 70 is configured with a transferring roller pair 71 including a transfer upper roller around which the intermediate transfer belt 50 is stretched, and a transfer lower roller that is pressed against the transfer upper roller side with the intermediate transfer belt 50 being disposed therebetween.

In the secondary transfer section 70, the roll sheet S conveyed by the conveying unit 73 is pressed against the intermediate transfer belt 50 side by the transfer lower roller. Then, the secondary transfer section 70 transfers the color toner image formed on the intermediate transfer belt 50 onto the roll sheet S conveyed by the conveying unit 73. A cleaning unit 52 removes the toner remaining on the surface of the intermediate transfer belt 50 after the toner image is transferred to the roll sheet S.

Furthermore, a transfer front sensor 74 is provided in the vicinity of the secondary transfer section 70 and on the upstream side of the secondary transfer section 70 in the sheet conveying direction. The transfer front sensor 74 detects presence or absence of the sheet (roll sheet S) on the upstream side of the secondary transfer section 70 in the sheet conveying direction.

The fixing section 10 is disposed on the ejection side of the roll sheet S in the secondary transfer section 70. The fixing section 10 includes a fixing belt 11 and a pressurizing roller 14, and pressurizes and heats the roll sheet S to fix, on the roll sheet S, the toner image transferred on the roll sheet S.

Figure 2:
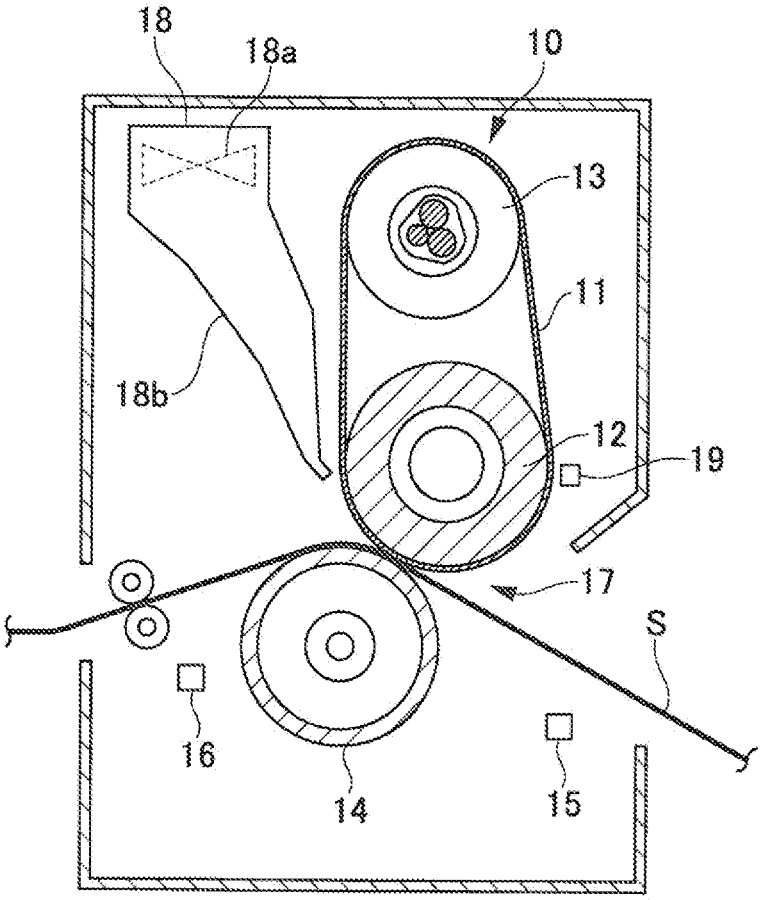
FIG. 2 is a schematic configuration diagram illustrating a configuration example of a fixing section of an image forming apparatus according to one embodiment of the present invention.

FIG. 2 illustrates a configuration example of the fixing section 10 in the image forming apparatus 1. As illustrated in FIG. 2, the fixing belt 11 is formed by an endless-shaped elastic member, and is stretched around a fixing roller 12 serving as a driving roller and a heating roller 13 serving as a driven roller. The fixing belt 11 is formed by an elastic member having tetrafluoroethylene (PFA) coated on a substrate surface layer made of polyimide (PI), for example.

The fixing roller 12 is formed by a cylindrical member having the outer diameter of 50 to 90 [mm], and has an elastic layer provided on a core bar and having the thickness, for example, of approximately 10 to 30 [mm]. The heating roller 13 is formed by a cylindrical member having the outer diameter of 50 to 90 [mm] and containing a halogen heater (hereinafter, also referred to as a "fixing heater"), and has a surface coated with polytetrafluoroethylene (PFTE).

The heating roller 13 is heated with the halogen heater, whereby the fixing belt 11 is heated. At this time, the fixing belt 11 is controlled so as to have temperatures in a range of approximately 160° C. to 210° C. The heated fixing belt 11 rotationally travels in a clockwise direction with rotational drive of the fixing roller 12.

The pressurizing roller 14 is formed by a cylindrical member having the outer diameter of 50 to 90 [mm], and has an elastic layer provided on a core bar and having the thickness, for example, of approximately 10 to 20 [mm]. The pressurizing roller 14 is provided so as to be press-contacted with the fixing roller 12 using a pressurizing mechanism (not illustrated) with the fixing belt 11 being disposed therebetween. The pressurizing roller 14 rotates in association with the fixing belt 11 that rotationally travels. In this embodiment, the surface of the pressurizing roller 14 has a linear velocity of 220 to 500 [mm/sec].

It should be noted that, in this embodiment, the pressurizing roller 14 is configured to follow the movement of the fixing belt 11. However, it may be possible to configure the pressurizing roller 14 as the driving roller. Furthermore, it may be possible to employ a configuration in which the pressurizing roller 14 is provided with a fixing heater.

A portion where the fixing belt 11 and the pressurizing roller 14 are brought into contact with each other forms a nip portion 17 of the fixing section 10. As the roll sheet S carrying the toner image passes through the nip portion 17 of the fixing section 10, the toner melts due to heat from the fixing belt 11 and the pressurizing roller 14, each of which is controlled so as to have a predetermined temperature, whereby the toner is fixed on the roll sheet S.

The blowing device 18 includes an axial fan 18*a* that blows a desired volume of air, and a nozzle section 18*b* that guides the air blown from the axial fan 18*a* so as to jet to the nip portion 17 and its surroundings. The nozzle section 18*b* has a top end portion having an elongated shape extending along a direction perpendicular to the rotational direction of the fixing belt 11. The longitudinal direction of the top end portion is provided so as to be substantially in parallel to the nip portion 17. With the configuration, it is possible to cause air to uniformly jet onto the roll sheet S passing through the nip portion 17. The volume of air jetting from the top end portion of the nozzle section 18*b* can be adjusted by varying the number of rotations of the axial fan 18*a* through control of values of electric current for driving the axial fan 18*a*.

The upstream-side sensor 15 is provided in the vicinity of the nip portion 17 formed by the fixing belt 11 and the pressurizing roller 14 and on the upstream side of the nip portion 17 in the sheet conveying direction. The upstream-side sensor 15 detects presence or absence of the sheet (roll sheet S) at a position facing the upstream-side sensor 15. The upstream-side sensor 15 also serves as a tension detecting section that detects tension of the roll sheet S. As the upstream-side sensor 15 also serves as the tension detecting section, it is possible to reduce the space as compared with a configuration in which the tension detecting section is separately provided.

The downstream-side sensor 16 is provided in the vicinity of the nip portion 17 formed by the fixing belt 11 and the pressurizing roller 14 and on the downstream side of the nip portion 17 in the sheet conveying direction. The downstream-side sensor 16 detects the existence or absence of the sheet (roll sheet S) at a position facing the downstream-side sensor 16.

The fixing section 10 includes a fixing-temperature sensor 19 that detects the temperature of the fixing section 10 (hereinafter, also referred to as a "fixing temperature"). The fixing-temperature sensor 19 is disposed, for example, in the vicinity of the fixing roller 12 to detect the temperature of the fixing section 10. The disposed position of the fixing-temperature sensor 19 illustrated in FIG. 2 is merely an example, and is not limited to that illustrated in FIG. 2. In other words, it is only necessary that the fixing-temperature sensor 19 is provided at a position where the temperature of the fixing section 10 can be detected.

In FIG. 1, the operation controlling section 65 is a touch screen including a display such as a liquid crystal display device and an organic electro luminescence (EL) display device. This operation controlling section 65 displays, for example, an instruction menu for a user or information on image data acquired. Furthermore, the operation controlling section 65 includes plural keys, and serves as an input section that receives input of data such as various instructions, characters, and numerals inputted through user's key operation. For example, with the operation controlling section 65, the user can input a sheet type for the roll sheet S set in the sheet feeding device 2.

Figure 3:
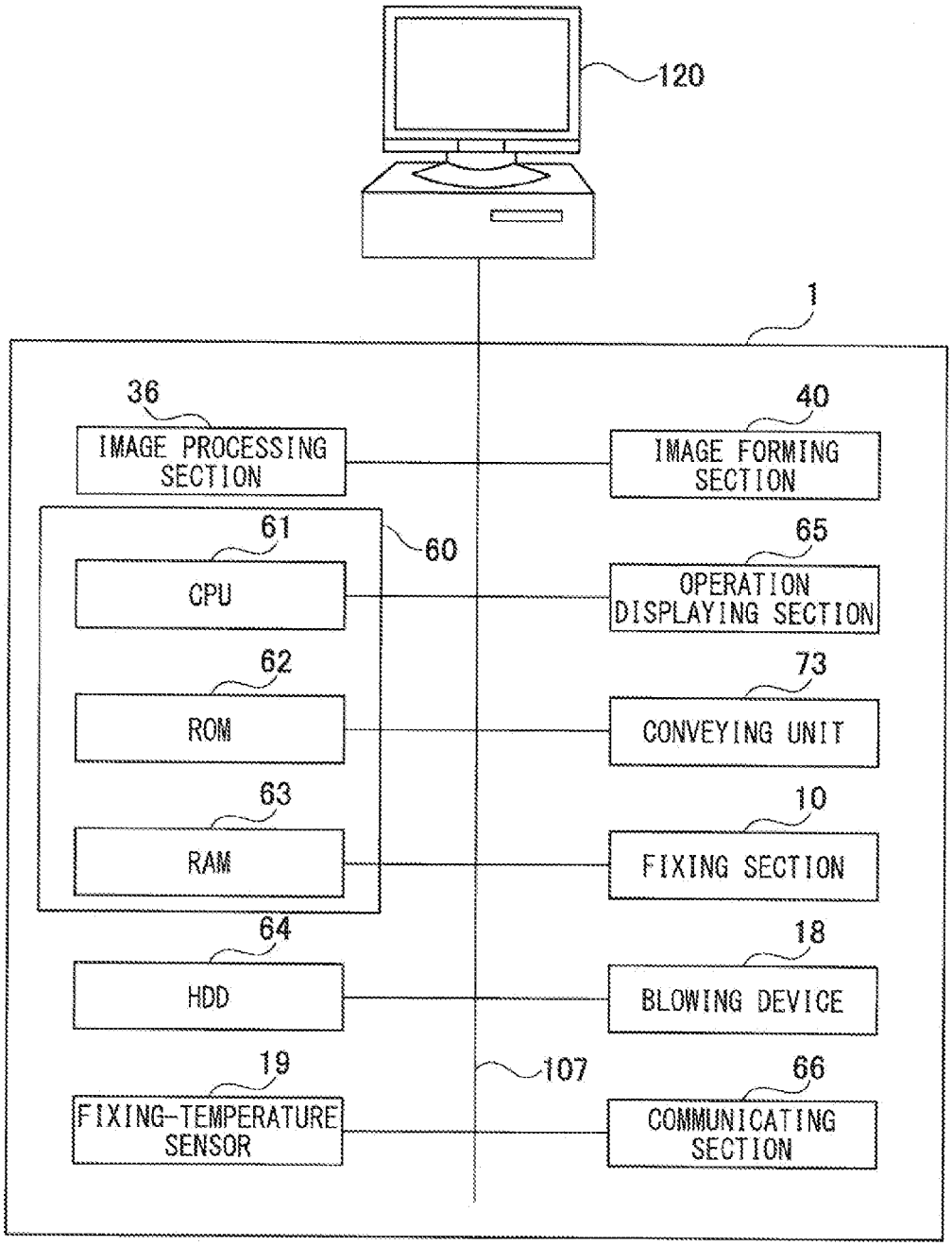
FIG. 3 is a block diagram showing a configuration example of a control system of the image forming apparatus according to one embodiment of the present invention.

The controller 60 controls each section in the image forming apparatus 1 in accordance with instructions from the operation controlling section 65 or external device (for example, a personal computer 120 illustrated in FIG. 3). Details thereof will be described later.

[Sheet Feeding Device and Sheet Receiving Device]

Next, the sheet feeding device 2 and the sheet receiving device 3 will be described. As illustrated in FIG. 1, the sheet feeding device 2 includes a conveying unit 21, a roll-sheet setting section 22, and a sheet feeding sensor 23. In the roll-sheet setting section 22, a roll sheet body 20 is provided in a rotatable manner, and has a desired roll sheet wound therearound. The conveying unit 21 includes plural conveying rollers, and conveys the roll sheet S fed from the roll-sheet setting section 22, to the image forming apparatus 1 side. The sheet feeding sensor 23 is provided, for example, in the vicinity of an ejection port through which the roll sheet S in the sheet feeding device 2 is ejected to the image forming apparatus 1 side, and detects presence or absence of the sheet (roll sheet S) at a position facing the sheet feeding sensor 23.

The sheet receiving device 3 includes a conveying unit 31, a winding section 32, and a sheet ejection sensor 33. The conveying unit 31 includes plural conveying rollers, and conveys the roll sheet S ejected to the sheet receiving device 3, to the winding section 32 side. The winding section 32 winds up the roll sheet S conveyed by the conveying unit 31 into a roll form. The sheet ejection sensor 33 is provided in the vicinity of an entrance for the roll sheet S conveyed from the image forming apparatus 1 side, and detects presence or absence of the sheet (roll sheet S) at a position facing the sheet ejection sensor 33.

[Configuration of Control System]

FIG. 3 is a block diagram showing a configuration example of a control system of the image forming apparatus according to the embodiment of the present invention. As illustrated in FIG. 3, the image forming apparatus 1 includes the controller 60, an image processing section 36, the image forming section 40, the operation displaying section 65, the conveying unit 73, a hard disk drive (HDD) 64, the fixing section 10, the blowing device 18, the fixing-temperature sensor 19, and a communicating section 66.

The controller 60 includes, for example, a central processing unit (CPU) 61, a read only memory (ROM) 62 for storing, for example, a program that the CPU 61 executes, and a random access memory (RAM) 63 used as a working area for the CPU 61. Note that a programmable ROM that is electrically erasable is usually used as the ROM 62.

The controller 60 is connected through a system bus 107 with the image processing section 36, the image forming section 40, the operation displaying section 65, the conveying unit 73, the HDD 64, the fixing section 10, the blowing device 18, and the communicating section 66, thereby controlling the entire image forming apparatus 1. The controller 60 further controls each section in the sheet feeding device 2 and the sheet receiving device 3 through the communicating section 66.

The image forming apparatus 1 is connected, for example, with a personal computer (PC) 120 serving as an external device. The PC 120 sends image data to the image forming apparatus 1. The image data sent from the PC 120 are sent to the image processing section 36, and are image-processed in the image processing section 36.

The image processing section 36 applies, to the received image data, various types of correction processing such as shading correction, image density correction, and color registration correction, or image processing such as image compression processing under control of the controller 60, as necessary. The image forming section 40 receives the image data image-processed by the image processing section 36 under control of the controller 60, and forms an image on the roll sheet S on the basis of the received image data.

The user can input type of roll sheet S (type of sheet) or perform other operations through the operation displaying section 65. The communicating section 66 serves as a communication interface for connecting the image forming apparatus 1 with a network where each of the devices constituting the image forming system 100 is connected. For example, the image forming apparatus 1 performs serial communication with the sheet feeding device 2 and the sheet receiving device 3 through the communicating section 66.

[Problem Concerning Standby Period]

Incidentally, since the roll sheet S is used as the recording medium in the image forming apparatus 1 of the image forming system 100 that forms images on the roll sheet S, the roll sheet S is set in the fixing section 10 even during standby (non-printing period of time) when printing is not performed. During printing operations, the roll sheet S is conveyed in a state where the fixing section 10 is set at a high temperature in order to fix the toner image on the roll sheet S.

The roll sheet S stops during standby. The roll sheet S is made of, for example, plastic-base paper such as coated paper. Thus, during standby, deformation or damage may occur in the roll sheet S due to the temperature in the fixing section 10. The deformation or damage of the roll sheet S leads to generation of waste sheet (spoiled sheet), and occurrence of troubles in sheet conveyance thereafter. Such troubles include, for example, trouble related to winding of the roll sheet S performed by the winding section 32 of the sheet receiving device 3.

Thus, during standby in which the roll sheet S stops, the temperature in the fixing section 10 needs to be decreased to a safe temperature at which deformation or damage does not occur in the roll sheet S. However, if the fixing section 10 is simply left to be naturally cooled, it takes long time for the temperature in the fixing section 10 to be decreased to the safe temperature at which deformation or damage does not occur in the roll sheet S, which results in an increase in the generated amount of waste sheets due to deformation or damage.

<Image Forming Apparatus According to the Embodiment of the Present Invention>

In the image forming apparatus 1 having the configuration described above, the controller 60 performs control of switching the fixing section 10 between the press-contact state and the separated state. Here, the wording "press-contact state" represents a state where the fixing belt 11 and the pressurizing roller 14 are brought into contact with each other, in other words, a state where the nip portion 17 is formed (see FIG. 2). The wording "separated state" represents a state where the contact between the fixing belt 11 and the pressurizing roller 14 is released. Furthermore, the controller 60 performs conveyance control of the roll sheet S by driving the conveying unit 73.

Furthermore, in the image forming apparatus 1 according to this embodiment, the roll sheet S is first conveyed at a first conveying speed from after completion of printing until a predetermined timing under control of the controller 60 while the fixing section 10 is being kept in the press-contact state. Subsequently, the fixing section 10 is brought into the separated state at the predetermined timing to convey the roll sheet S at a second conveying speed, which is slower than the first conveying speed. Then, conveyance of the roll sheet S is stopped at a time when the temperature of the fixing section 10 becomes not higher than a predetermined temperature.

Below, with reference to FIG. 4, specific description will be made of control of switching the fixing section 10 between the press-contact state and the separated state, and conveyance control of the roll sheet S. After completion of printing on the roll sheet S, which is a long sheet, the controls with the controller 60 are performed by combination of two cooling operations: rapid cooling illustrated in FIG. 4A and natural cooling illustrated in FIG. 4B. Hereinafter, the roll sheet S is also referred to as a sheet S.

(Rapid Cooling)

Figure 4A:
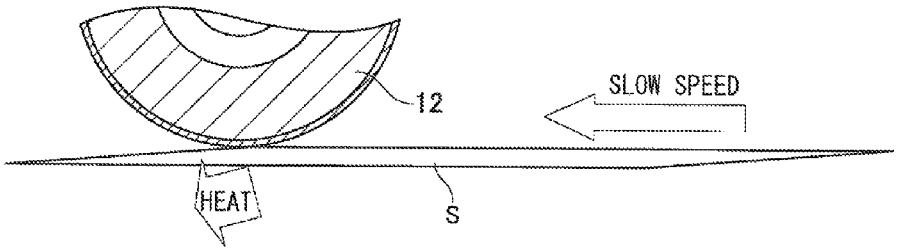

During rapid cooling, the sheet S is used as a heat dissipating body to perform cooling as illustrated in FIG. 4A. More specifically, in a state where the fixing heater (halogen heater of the heating roller 13) is turned off immediately after completion of printing, the fixing section 10 is brought into the press-contact state as in printing. In addition, an imaging system of forming images is stopped. The sheet S is conveyed at a first conveying speed, which is a slow speed, for example, of approximately 65 [mm/sec].

Conveying the sheet S at a slow speed while keeping the fixing section 10 in the press-contact state allows heat of the fixing section 10 to be transferred to the sheet S through thermal conduction and to be dissipated with the sheet S functioning as a heat dissipating body. In other words, the recording medium functions as the heat dissipating body. Thereby, rapid cooling (forced cooling) is performed on the fixing section 10, and thus decrease in the temperature of the fixing section 10 is accelerated. Since the sheet S is conveyed at a slow speed during rapid cooling, heat of the fixing section 10 is absorbed by a white paper sheet to be dissipated. The white paper sheet used here is treated as a waste sheet.

Figure 5:
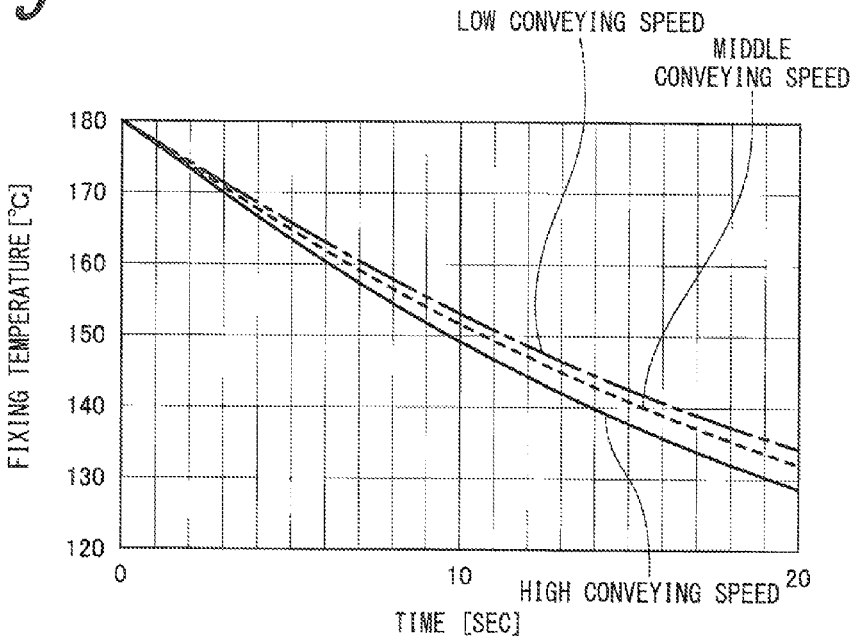
FIG. 5 is a diagram illustrating examples of relationships between time and fixing temperatures of the fixing section in a press-contact state at various sheet conveying speeds.

FIG. 5 illustrates examples of relationships between time and fixing temperatures of the fixing section 10 in the press-contact state at various conveying speeds of the sheet S. In order to facilitate understanding, FIG. 5 illustrates that the sheet S is conveyed at three different conveying speeds: high, middle, and low speeds in a comparative manner, in which a high conveying speed is shown in a solid line, a middle conveying speed is shown in a dotted line, and a low conveying speed is shown in a dot-and-dash line. From FIG. 5, it can be understood that, as the conveying speed of the sheet S increases (in the case of the higher conveying speed), the fixing temperature in the press-contact state rapidly decreases. In the example illustrated in FIG. 5, the temperature decreases from 180° C. to approximately 135 degrees after 20 seconds elapse since cooling starts in the case of the low conveying speed, whereas the temperature decreases from 180° C. to approximately 128° C. after 20 seconds elapse from cooling starts in the case of the high conveying speed.

(Natural Cooling)

Figure 4B:
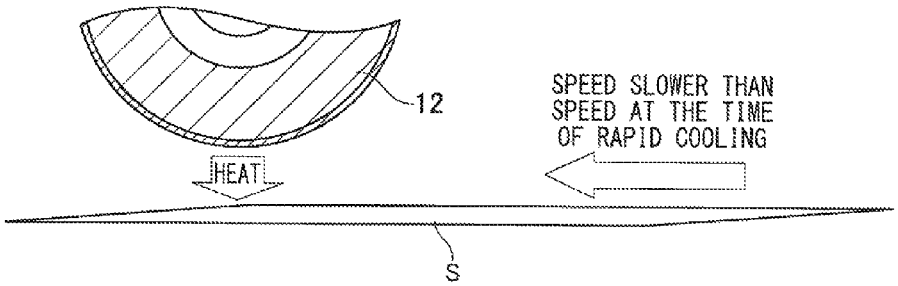

As the operation of rapid cooling progresses, the fixing section 10 is released from the press-contact state and brought into the separated state as illustrated in FIG. 4B at a predetermined timing such as a timing at which the temperature of the fixing section 10 reaches a temperature set in advance (for example, 140° C.). The temperature of the fixing section 10, namely, the fixing temperature can be detected with the fixing-temperature sensor 19 (see FIG. 2).

Here, a timing (predetermined timing) at which the press-contact state is released is set on the basis of the fixing temperature. However, it may be possible to employ a time or the amount (length) of waste sheets instead. In the case where the time is employed, it is only necessary to set in advance a time required for the fixing temperature to reach a temperature set in advance from after completion of printing. In the case where the amount of waste sheets is employed, it is only necessary to set in advance the amount of roll sheet S conveyed until the fixing temperature reaches a predetermined temperature set in advance from after completion of printing, as the amount of waste sheets.

After the fixing section 10 is brought into the separated state, the sheet S is conveyed at a second conveying speed, which is slower than the first conveying speed in the press-contact state. Accordingly, natural cooling is performed on the fixing section 10. During the natural cooling, the sheet S is conveyed at a slow speed slower than the conveying speed at the time of rapid cooling, so that the amount of movement (conveyance amount) of the sheet S is smaller than that during the rapid cooling, which makes it possible to reduce the generated amount of waste sheets. Then, conveyance of the sheet S is stopped when the fixing temperature reaches a predetermined temperature, more specifically, a temperature not higher than a temperature (for example, approximately 100° C.) at which damage such as deformation does not occur in the sheet S.

Figure 6:
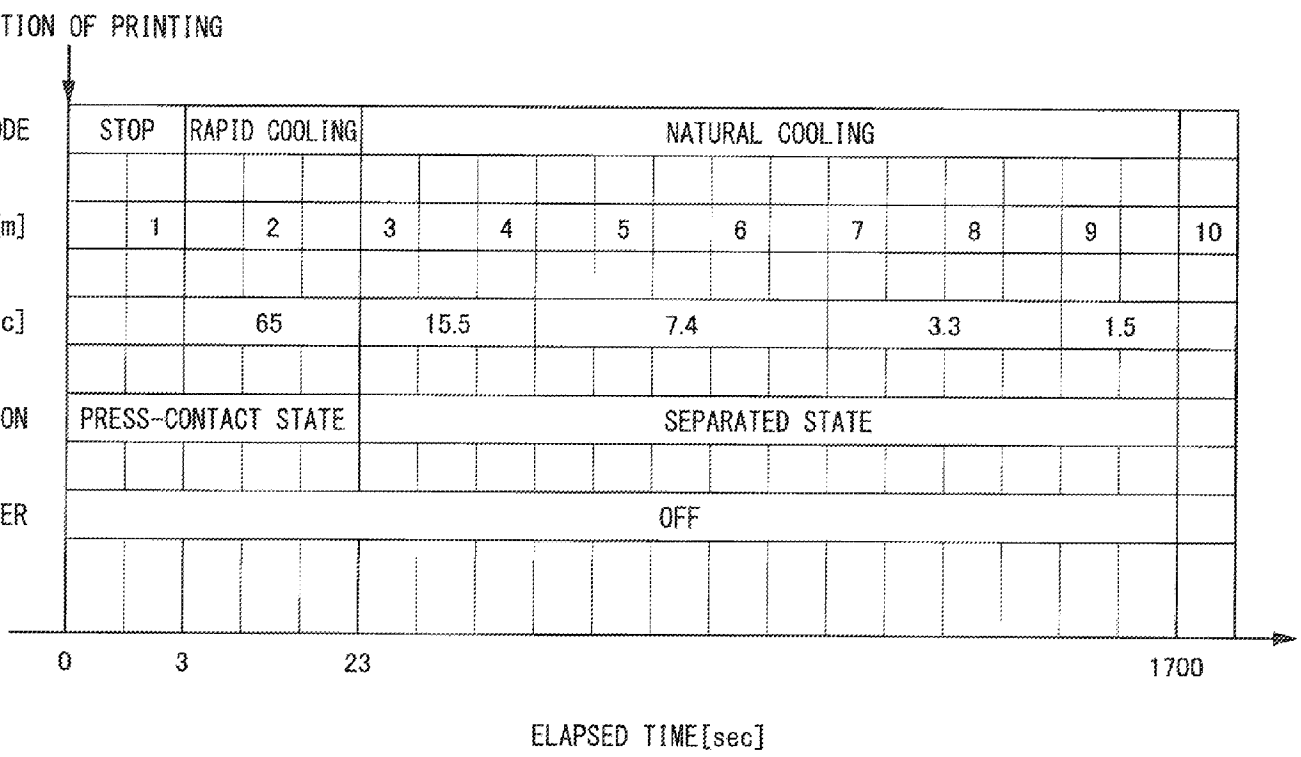
FIG. 6 is a timing chart showing an example of timings during cooling operations of the fixing section.

FIG. 6 is a timing chart showing an example of timings during cooling operation of the fixing section 10. The timing chart in FIG. 6 shows relationships among operation modes, lengths of waste sheet, sheet conveying speeds, states (press-contact state or separated state) of the fixing section 10, and the fixing heater (fixing temperature) with respect to elapsed time after completion of printing.

The timing chart in FIG. 6 illustrates timings concerning an example of operations in which: the imaging system is stopped at completion of printing; the rapid cooling mode starts three seconds after the stop; the natural cooling mode starts 23 seconds later; conveyance of the sheet S is stopped 1700 seconds later; and the cooling operation ends.

(Continuous Control of Conveying Speed During Cooling)

The conveying speed of the sheet S during cooling is controlled so as to continuously decrease according to elapsed time. Fox example, as illustrated in the timing chart in FIG. 6, the conveying speed of the sheet S during natural cooling is controlled so as to continuously decrease to 15.5 [mm/sec], 7.4 [mm/sec], 3.3 [mm/sec], and 1.5 [mm/sec] according to elapsed time.

As the fixing temperature decreases through natural cooling in accordance with elapsed time, control of the conveying speed is performed so as to continuously decrease the conveying speed of the sheet S in accordance with the decrease in the fixing temperature. If the fixing temperature is relatively high, the conveying speed is increased and the amount of movement (conveyance amount) of the sheet S is increased, whereby it is possible to reduce the effect of heat of the fixing section 10 on the sheet S. If the fixing temperature is relatively low, the effect of heat of the fixing section 10 on the sheet S is small. Thus, the conveying speed is decreased, and the amount of movement of the sheet S is reduced. In other words, control is performed so that the conveyed amount of sheet S after the fixing section 10 is brought into the separated state, that is, the amount of movement of the sheet S is reduced as the temperature of the fixing section 10 decreases.

The conveying speed of the sheet S in the natural cooling mode is controlled so as to continuously decrease in accordance with the decrease in the fixing temperature as described above, whereby it is possible to appropriately decrease (cool) the temperature of the fixing section 10. Thus, time required for cooling the fixing section 10 can be reduced. Furthermore, it is possible to reduce the amount (length) of waste sheets generated after completion of printing.

Figure 7:
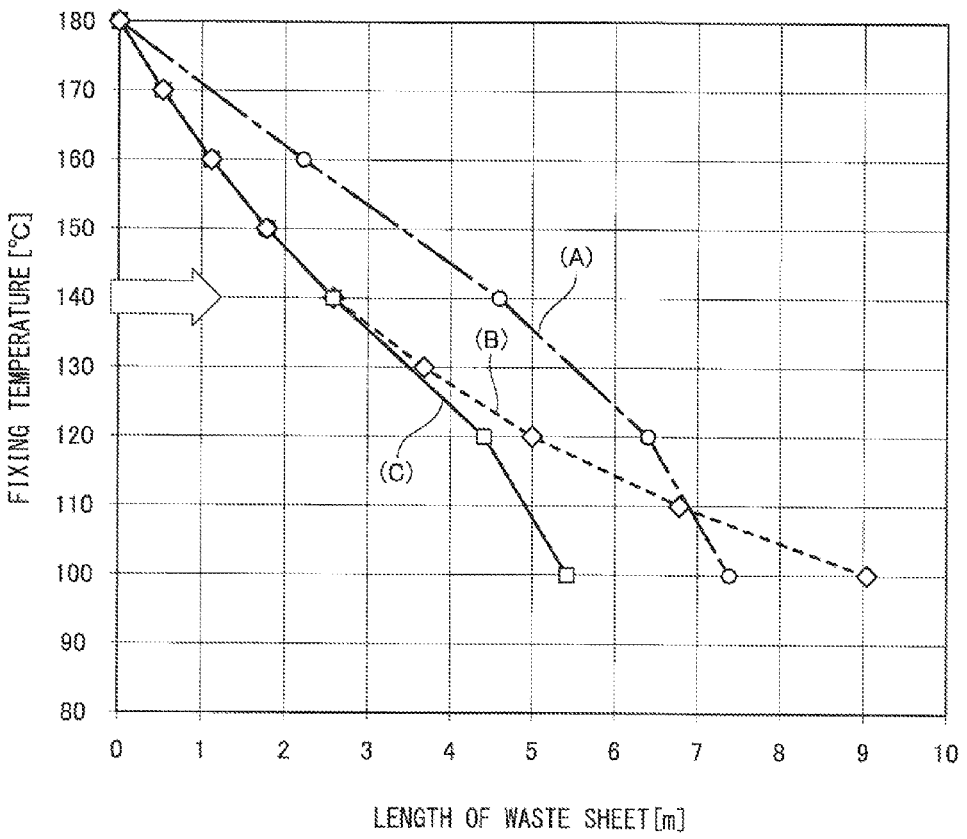
FIG. 7 is a diagram illustrating an example of a relationship between the fixing temperature and the amount (length) of waste sheet in the case where the fixing temperature at the time of printing is set to 180° C.

FIG. 7 is a diagram illustrating an example of a relationship between the fixing temperature and the amount (length) of waste sheets in the case where the fixing temperature at printing is set to 180° C. FIG. 7 shows a case (A) where natural cooling is performed with the fixing section 10 set in the separated state throughout the cooling period, a case (B) where rapid cooling is performed with the fixing section 10 set in the press-contact state during the cooling period, and a case (C) of cooling according to this embodiment, that is, cooling by combination of rapid cooling and natural cooling. In the case (C) of cooling by combination of rapid cooling and natural cooling, the fixing section 10 is set in the separated state at a fixing temperature of 140° C.

As is clear from FIG. 7, the amount of waste sheets, in other words, the length of waste sheet can be reduced in the case (C) where cooling by combination of rapid cooling and natural cooling is performed as in this embodiment, as compared with the case (A) of only natural cooling or the case (B) of only rapid cooling.

More specifically, the length of waste sheet results in 2.6 [m] at temperatures ranging from 180° C. to 140° C. in the case (C) of cooling by combination of rapid cooling and natural cooling, which is the same as in the case where rapid cooling is performed during the cooling period with the fixing section 10 being set in the press-contact state, in other words, in the case (B) of only rapid cooling. Furthermore, the length of waste sheet results in 2.6 (=7.4-4.6) [m] at temperatures not higher than 140° C., which is the same as in the case where natural cooling is performed during the cooling period with the fixing section 10 being set in the separated state, in other words, in the case (A) of only natural cooling.

Consequently, in the case (C) of cooling by combination of rapid cooling and natural cooling, the length of waste sheet results in 5.4 [m] at a time when the fixing temperature reaches 100° C. at which damage does not occur in the sheet S. On the other hand, the length of waste sheet results in 7.4[m] in the case (A) where natural cooling is performed during the cooling period with the fixing section 10 being set in the separated state, and the length of waste sheet results in 9.1 [m] in the case (B) where rapid cooling is performed during the cooling period with the fixing section 10 being set in the press-contact state.

From the results described above, it can be understood that the case (C) of cooling by combination of rapid cooling and natural cooling is superior to the case (A) of only natural cooling or the case (B) of only rapid cooling. Note that the time required for the fixing temperature to decrease from 180° C. to 100° C. is 2300 [sec] in the case (A) of only natural cooling, is 18 [sec] in the case (B) of only rapid cooling, and is 1663 [sec] in the case (C) of cooling by combination of rapid cooling and natural cooling.

(Intermittent Control of Conveying Speed During Cooling)

Furthermore, it may be possible to employ control in which the conveying speed of the sheet S during cooling is reduced through intermittent drive in accordance with the fixing temperature (intermittent control), in place of control in which the conveying speed is continuously reduced. In the case of the intermittent control, the conveying speed of the sheet S is an average speed. The intermittent drive of the conveying speed of the sheet S can be easily achieved, for example, by using a known stepping motor serving as a drive source for the conveying unit 73 (see FIG. 1).

Figures 8, 9:
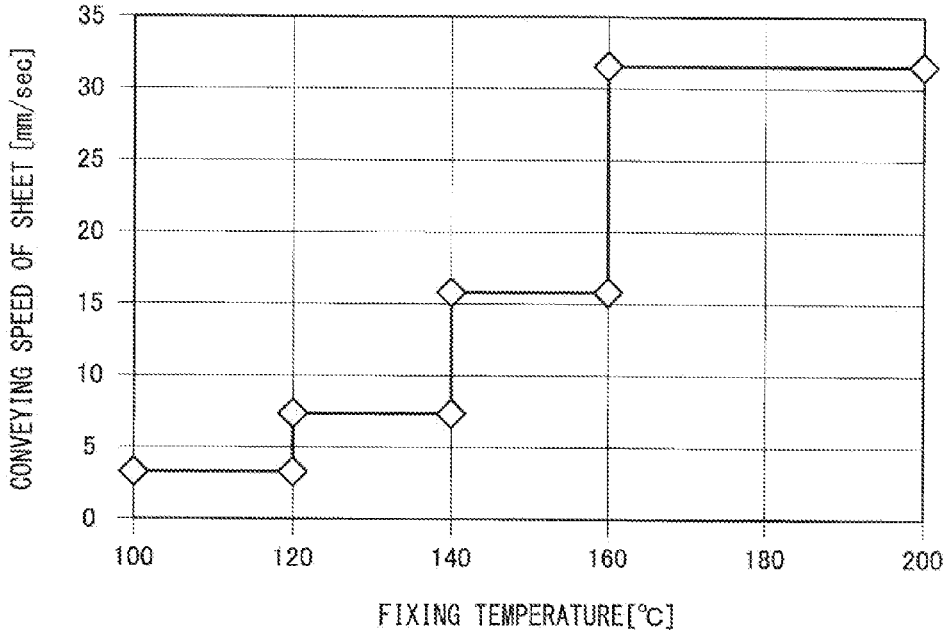
FIG. 8 is a diagram illustrating a specific example in which conveying speeds of a sheet are intermittently driven according to fixing temperatures.
FIG. 9 is a diagram illustrating an example of a correlation between fixing temperatures and conveying speeds through intermittent drive.

With reference to FIG. 8, description will be made below of a specific example in which intermittent drive is performed on the conveying speed of the sheet S in accordance with the fixing temperature.

FIG. 8 is a diagram illustrating a specific example to intermittently drive the conveying speed of the sheet S according to the fixing temperature. In FIG. 8, "ON" represents a driving period of conveying the sheet S, and "OFF" represents a stopping period of not conveying the sheet S. In accordance with the ON (driving)/OFF (stopping), the intermittent drive is performed on the conveying speed of the sheet S. Here, the ON period is set to 0.1 [sec] as one example. The OFF period is set to 0.3 [sec], 0.7 [sec], 1.6 [sec], 3.7 [sec], 8.4 [sec], and 19.3 [sec] so as to be longer in a stepwise manner.

In the case where the OFF period is 0.3 [sec], the average speed is 31.6 [mm/sec]. In the case where the OFF period is 0.7 [sec], the average speed is 15.8 [mm/sec]. In the case where the OFF period is 1.6 [sec], the average speed is 7.4 [mm/sec]. In the case where the OFF period is 3.7 [sec], the average speed is 3.3 [mm/sec]. In the case where the OFF period is 8.4 [sec], the average speed is 1.5 [mm/sec]. In the case where the OFF period is 19.3 [sec], the average speed is 0.8 [mm/sec].

In connection with the intermittent drive described above, the present inventors already confirm that the sheet S deforms due to occurrence of bubbles at fixing temperatures of 180° C. or 160° C. in the case of intermittent drive in which the ON period is 0.1 [sec] and the OFF period is 1.6 [sec]. The deformation of the sheet S caused by bubbles occurs in the case where the sheet S is made of plastic-based paper such as coated paper. In the case of the intermittent drive in which the ON period is 0.1 [sec] and the OFF period is 3.7 [sec], bubbles occur in the sheet S at fixing temperatures of 160° C. or 140° C., which leads to deformation of the sheet S. In the case of the intermittent drive in which the ON period is 0.1 [sec] and the OFF period is 19.3 [sec], the sheet S slightly deforms at a fixing temperature of 120° C.

In this embodiment, preferable intermittent drives are selected in the following manner on the basis of the measurement results. The preferable intermittent drives are selected to be the intermittent drive in which the ON period is 0.1 [sec] and the OFF period is 0.3 [sec] in the case of a fixing temperature of 180° C., and the intermittent drive in which the ON period is 0.1 [sec] and the OFF period is 0.7 [sec] in the case of a fixing temperature of 160° C. Furthermore, the preferable intermittent drives are selected to be the intermittent drive in which the ON period is 0.1 [sec] and the OFF period is 1.6 [sec] in the case of a fixing temperature of 140° C., and the intermittent drive in which the ON period is 0.1 [sec] and the OFF period is 3.7 [sec] in the case of a fixing temperature of 120° C.

FIG. 9 illustrate one example of a correlation between fixing temperatures during the intermittent drives as selected above and conveying speeds. Here is illustrated a case where the fixing temperature at printing is set to 200° C.

In the example, during rapid cooling period in which the fixing temperature ranges from 200° C. to 140° C., the intermittent drive in which the ON period is 0.1 [sec] and the OFF period is 0.3 [sec] is performed with the conveying speed (average speed) of the sheet S being set to 31.6 [mm/sec] until the fixing temperature decreases to 160° C. Then, until the fixing temperature decreases to 140° C., the intermittent drive in which the ON period is 0.1 [sec] and the OFF period is 0.7 [sec] is performed with the conveying speed of the sheet S being set to 15.8 [mm/sec].

During natural cooling period in which the fixing temperature ranges from 140° C. to 100° C., the intermittent drive in which the ON period is 0.1 [sec] and the OFF period is 1.6 [sec] is performed with the conveying speed of the sheet S being set to 7.4 [mm/sec] until the fixing temperature decreases to 120° C. Then, until the fixing temperature decreases to 100° C., the intermittent drive in which the ON period is 0.1 [sec] and the OFF period is 3.7 [sec] is performed with the conveying speed of the sheet S being set to 3.3 [mm/sec].

As described above, in the case of the driving method in which intermittent drive (intermittent control) is performed on the conveying speed of the sheet S during cooling in accordance with the fixing temperature, the intermittent drive can be easily achieved using a stepping motor, which provides an advantage in which control of the conveying speed of the sheet S can be easily achieved, as compared with the driving method in which the conveying speed is continuously controlled.

[Method of Controlling Cooling Operation for Fixing Section]

Next, description will be made of a specific example of a method of controlling a cooling operation for the fixing section 10 according to this embodiment, which is performed by combination of two cooling operations: rapid cooling and natural cooling. In Example 1 to Example 3 described below, it is assumed that upon completion of printing, the processing flow starts, and the fixing section 10 is kept in the press-contact state. Furthermore, it is also assumed that the controlling method according to Example 1 to Example 3 is performed under control by the controller 60 (see FIG. 3), and the sheet S is conveyed during cooling through intermittent drive.

EXAMPLE 1

Figure 10:
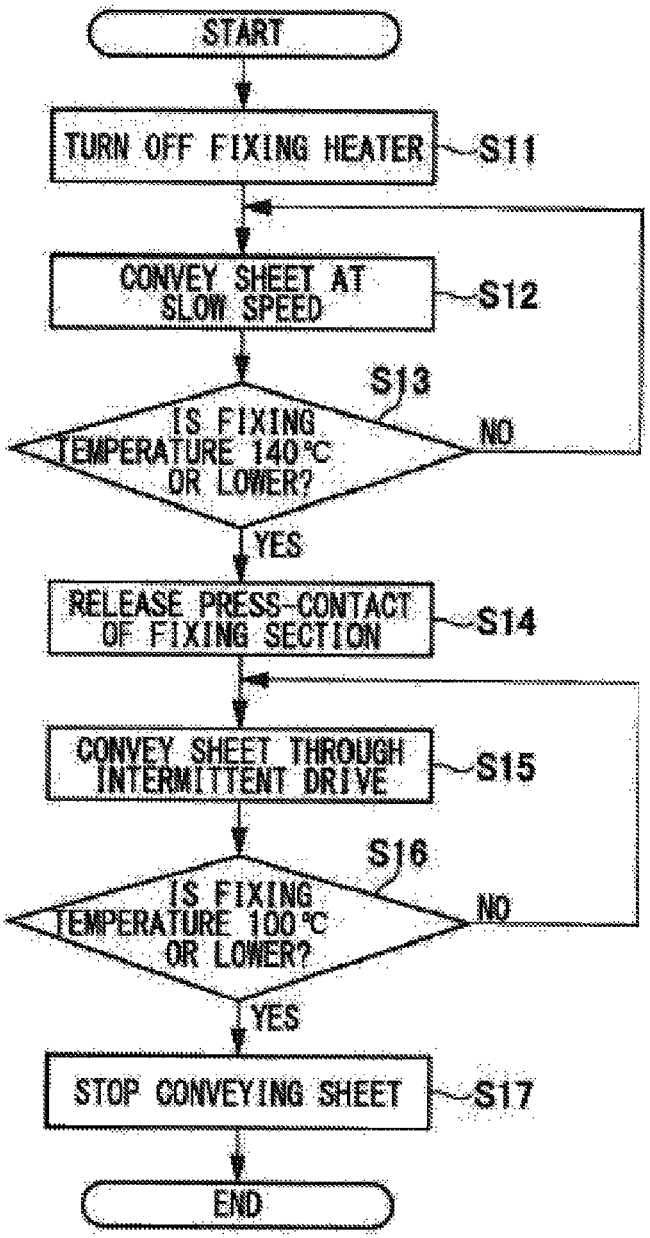
FIG. 10 is a flowchart showing one example of a processing procedure concerning a controlling method according to Example 1.

FIG. 10 is a flowchart showing one example of a processing procedure concerning a controlling method according to Example 1, which is one example of an image forming method according to the present invention.

Upon completion of printing, the controller 60 causes the fixing heater (halogen heater of the heating roller 13) of the fixing section 10 to turn off (step S11), and then, causes the sheet S to be conveyed at a constant, slow speed, for example, of approximately 65 [mm/sec] (step S12). Next, the controller 60 determines whether the fixing temperature becomes not higher than a temperature set in advance, for example, 140° C. (step S13). If the controller 60 determines that the fixing temperature is higher than 140° C. (NO in step S13), the processing flow returns to step S12 and continues conveyance of the sheet at the slow speed.

If the controller 60 judges that the fixing temperature is not higher than 140° C. (YES in step S13), the press-contact state of the fixing section 10 is released to bring the fixing section 10 into the separated state (step S14), and then, conveyance drive is performed on the sheet S through intermittent drive (step S15). During the intermittent drive, the sheet S is conveyed at a conveying speed slower than the slow speed set in step S12. Next, the controller 60 determines whether the fixing temperature reaches a temperatures at which damage such as deformation does not occur in the sheet S, for example, 100° C. (step S16). If it is determined that the fixing temperature is higher than 100° C. (NO in step S16), the processing flow returns to step S15 and continues conveyance of the sheet through intermittent drive.

If the controller 60 determines that the fixing temperature is not higher than 100° C. (YES in step S16), the controller 60 stops conveyance of the sheet S (step S17), and ends a series of cooling processes with a combination of two cooling operations: rapid cooling and natural cooling.

As described above, according to the controlling method of Example 1, cooling operations are performed on the fixing section 10 by combination of rapid cooling in which the sheet S is used as a heat dissipating body to cool the fixing section 10, and natural cooling in which the sheet S is conveyed at a slow speed, so that the fixing section 10 can be appropriately cooled. Thereby, it is possible to reduce the amount of waste sheets generated due to deformation or damage.

EXAMPLE 2

Figure 11:
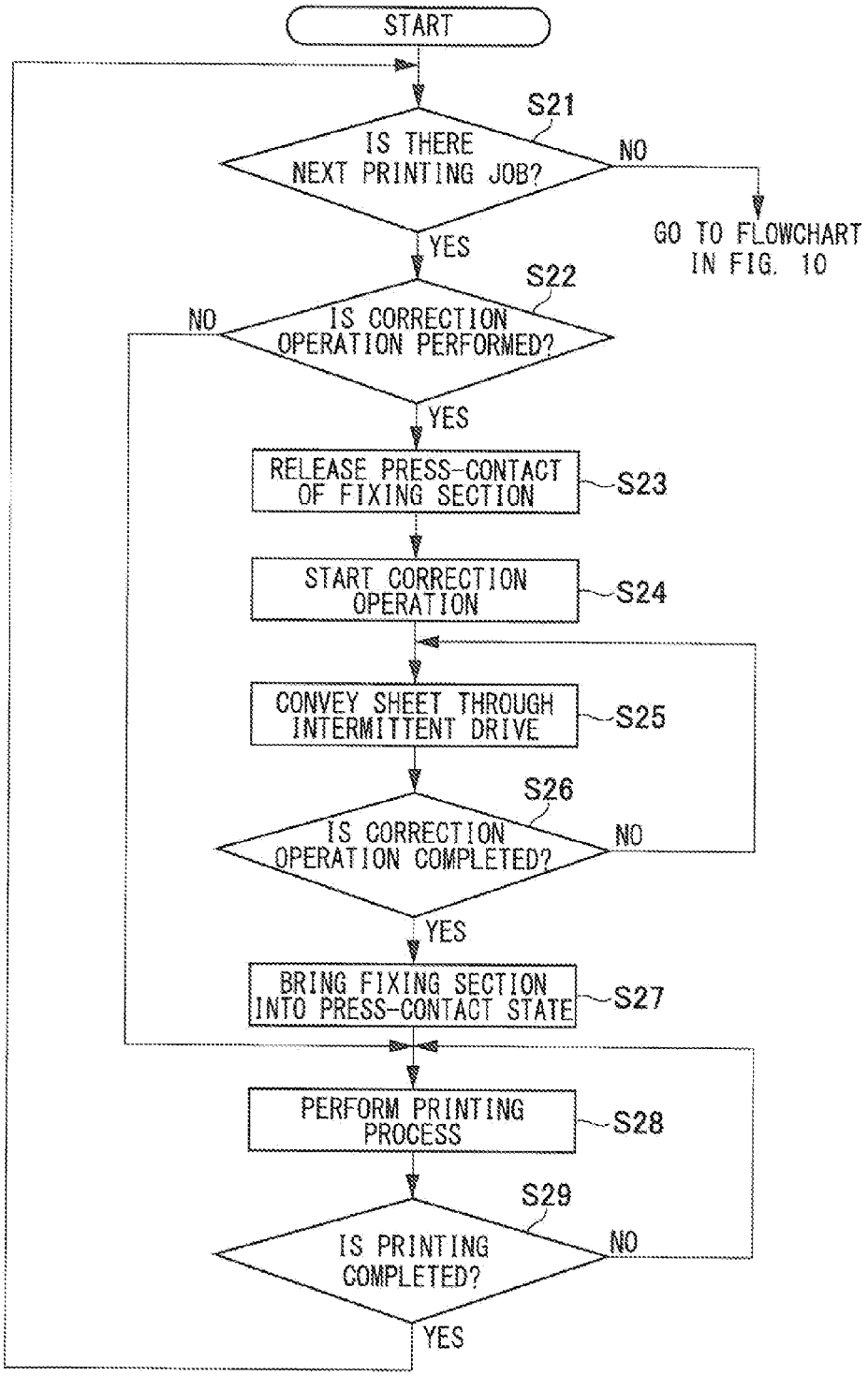
FIG. 11 is a flowchart showing one example of a processing procedure concerning a controlling method according to Example 2.

FIG. 11 is a flowchart showing one example of a processing procedure concerning a controlling method according to Example 2, which is another example of the image forming method according to the present invention.

Upon completion of printing, the controller 60 determines whether there is any next printing job (step S21). If there is no next printing job (NO in step S21), processing moves to the flowchart shown in FIG. 10 to perform a series of cooling processes by combination of rapid cooling and natural cooling. The next printing job is given by a user through an order operation using the operation controlling section 65 (see FIG. 1).

The controller 60, when determining that there is a next printing job (YES in step S21), determines whether to perform a correction operation (step S22). If the controller 60 determines to perform the correction operation (YES in step S22), the controller 60 ends the press-contact state of the fixing section 10 (step S23), and then, starts a correction operation (step S24). The correction operation includes operations such as color registration correction and image density correction.

Next, the controller 60 performs conveyance drive on the sheet S through intermittent drive (step S25), and then determines whether the correction operation ends (step S26). If the controller 60 determines that the correction operation does not end (NO in step S26), the processing flow returns to step S25 and continues conveyance of the sheet through intermittent drive. The controller 60, when determining that the correction operation ends (YES in step S26), brings the fixing section 10 into the press-contact state (step S27).

Next, the controller 60 performs a printing process (step S28), and then determines whether the printing process ends (step S29). If the controller 60 determines that the printing process does not end (NO in step S29), the processing flow returns to step S28 and continues the printing process. If the controller 60 determines that the printing process ends (YES in step S29), the processing flow returns to step S21 and repeats processes from step S21 to step S29.

It should be noted that, if the controller 60 determines in step S22 that no correction processing is performed (NO in step S22), the processing flow moves to step S28 to perform a printing process.

As described above, according to the controlling method of Example 2, the determination process is performed as to whether there is any next printing job. Thus, if there is no next printing job, it is possible to immediately move the process to the cooling operation of the fixing section 10 by combination of rapid cooling and natural cooling. Furthermore, if a next printing job exists, it is possible to immediately move the process to the next printing operation including a correction operation.

EXAMPLE 3

Figure 12:
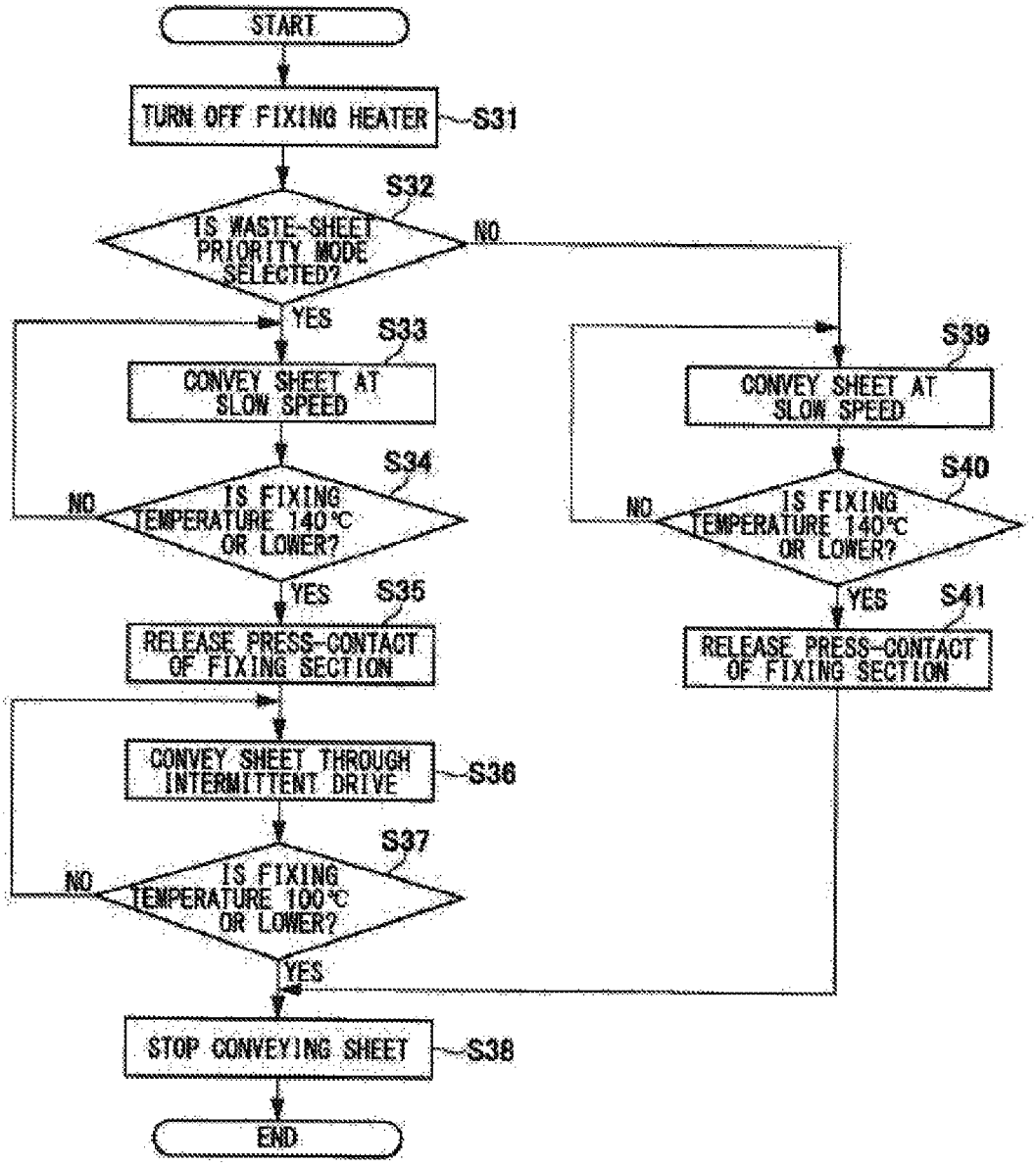
FIG. 12 is a flowchart showing one example of a processing procedure concerning a controlling method according to Example 3.

FIG. 12 is a flowchart showing one example of a processing procedure concerning a controlling method according to Example 3, which is another example of the image forming method according to the present invention.

Upon completion of printing, the controller 60 determines whether a waste-sheet priority mode is selected (step S32). The waste-sheet priority mode is selected by a user performing a selecting operation using the operation controlling section 65 (see FIG. 1). The controller 60, when determining that the waste-sheet priority mode is selected (YES in step S32), moves to a process of the waste-sheet priority mode, and when the waste-sheet priority mode is not selected (NO in step S32), moves to a process of a time priority mode.

—Process of Waste-Sheet Priority Mode

The controller 60, once moving to the waste-sheet priority mode, controls the sheet S to be conveyed at a constant, slow speed, for example, of approximately 65 [mm/sec] (step S33), and then, determines whether the fixing temperature becomes not higher than a temperature set in advance, for example, 140° C. (step S34). If the fixing temperature is higher than 140° C. (NO in step S34), the controller 60 returns to step S33, and conveyance of the sheet at the slow speed continues. If the controller 60 determines that the fixing temperature is not higher than 140° C. (YES in step S34), the controller 60 releases the press-contact state of the fixing section 10 (step S35).

Next, the controller 60 performs conveyance drive on the sheet S through intermittent drive (step S36), and then determines whether the fixing temperature reaches a temperature at which the sheet S does not deform or suffer other damages, for example, is not higher than 100° C. (step S37). If the fixing temperature is higher than 100° C. (NO in step S37), the controller 60 returns to step S36, and causes the sheet to be conveyed through intermittent drive. On the other hand, the controller 60, when determining that the fixing temperature is not higher than 100° C. (YES in step S37), stops conveying the sheet S (step S38), and ends the cooling process with the waste-sheet priority mode by combination of two cooling operations of rapid cooling and natural cooling.

—Process of Time Priority Mode

The controller 60, once moving to the time priority mode, causes the sheet S to be conveyed at a constant, slow speed, for example, of approximately 65 [mm/sec] (step S39), and then determines whether the fixing temperature reaches a predetermined temperatures, for example, is not higher than 140° C. (step S40). If the fixing temperature does not reach 140° C. (NO in step S40), the controller 60 returns to step S39, and conveyance of the sheet at the slow speed continues. The controller 60, when determining that the fixing temperature is higher than 140° C. (YES in step S40), moves to step S38, and stops conveying the sheet S. More specifically, in the time priority mode, only the rapid cooling, in which the sheet S is conveyed at the first conveying speed (for example, at a slow speed of approximately 65 [mm/sec]) while the fixing section 10 is being kept in the press-contact state, is performed during a period of time from the completion of printing until the temperature of the fixing section 10 is not higher than 140° C., thereby performing the cooling operation.

As described above, according to the controlling method of Example 3, a user can select the waste-sheet priority mode and the time priority mode. In the waste-sheet priority mode, a cooling operation by combination of two cooling operations of rapid cooling and natural cooling is performed on the fixing section 10, which provides an advantage that the amount (length) of waste sheets can be reduced as compared with the time priority mode (see FIG. 7). On the other hand, in the time priority mode, a cooling operation is performed on the fixing section 10 only by rapid cooling, which provides an advantage that it is possible to reduce the time required for the temperature of the fixing section 10 to decrease to a safe temperature at which deformation or damage does not occur in the roll sheet S, as compared with the waste-sheet priority mode (see FIG. 5).

What is claimed is:

1. An image forming apparatus, comprising:

a fixing section configured to fix a toner image on a recording medium; and a controller configured to perform control of switching the fixing section between a press-contact state and a separated state, and conveyance control of controlling a conveying speed of the recording medium, wherein the controller:

conveys the recording medium at a first conveying speed after completion of printing while keeping the fixing section in the press-contact state;

then brings the fixing section into the separated state at a predetermined timing to convey the recording medium at a second conveying speed slower than the first conveying speed; and stops conveying the recording medium at a time when a temperature of the fixing section becomes not higher than a predetermined temperature.

2. The image forming apparatus according to claim 1, wherein the predetermined timing is a timing at which the temperature of the fixing section becomes not higher than a temperature set in advance.

3. The image forming apparatus according to claim 1, wherein the controller varies the conveying speed of the recording medium to perform control such that a conveyance amount of the recording medium after the fixing section has been brought into the separated state decreases as the temperature of the fixing section decreases.

4. The image forming apparatus according to claim 1, wherein in the case where a next printing job exists at completion of printing, the controller brings the fixing section into the separated state after completion of printing, and moves to a process for the next printing.

5. The image forming apparatus according to claim 1, wherein the controller has a mode of conveying the recording medium at the first conveying speed while keeping the fixing section in the press-contact state during a period of time from after completion of printing until the temperature of the fixing section becomes not higher than a temperature set in advance.

6. An image forming method of an image forming apparatus including a fixing section that fixes a toner image on a recording medium, the image forming method comprising:

conveying the recording medium at a first conveying speed after completion of printing while keeping the fixing section in a press-contact state; and then bringing the fixing section into a separated state at a predetermined timing to convey the recording medium at a second conveying speed slower than the first conveying speed, and stopping conveying the recording medium at a time when a temperature of the fixing section becomes not higher than a predetermined temperature.

* * * * *